US007716886B2

(12) United States Patent
Gordon

(10) Patent No.: US 7,716,886 B2
(45) Date of Patent: May 18, 2010

(54) JAMB INSTALLATION BRACKET

(76) Inventor: Randy S. Gordon, 9247 E. Trey Blvd., Hesperia, MI (US) 49421

( * ) Notice: Subject to any disclaimer, the term of this patent is extended or adjusted under 35 U.S.C. 154(b) by 227 days.

(21) Appl. No.: 11/860,463

(22) Filed: Sep. 24, 2007

(65) Prior Publication Data

US 2009/0077910 A1 Mar. 26, 2009

(51) Int. Cl.
*E06B 1/60* (2006.01)

(52) U.S. Cl. ..... 52/213; 52/127.1; 52/712; 206/325

(58) Field of Classification Search ..... 52/126.1, 52/126.3, 127.1, 204.1, 204.55, 204.56, 205, 52/210, 211, 212, 213, 215, 217, 713, 714, 52/716, 718, 745.15, 745.16, 760, 285.3; 49/380, 467, 468, 504, 505, DIG. 1; 24/350; 411/457, 461, 473, 920; 206/325; 248/221.11, 248/220.21

See application file for complete search history.

(56) References Cited

U.S. PATENT DOCUMENTS 1,308,276 A 7/1919 Connell
2,427,393 A * 9/1947 Eckel ..... 29/515
1,621,213 A 3/1957 Olson
2,818,947 A 1/1958 Goldberg
3,113,358 A * 12/1963 Zell et al. ..... 312/263
3,205,982 A * 9/1965 Chimienti ..... 206/325
3,226,781 A 1/1966 Schnabel
3,250,049 A 5/1966 Sklar
3,430,385 A * 3/1969 Biro ..... 49/380
3,490,797 A * 1/1970 Platte ..... 52/282.1
3,675,955 A * 7/1972 Hajduk ..... 217/65
3,884,003 A * 5/1975 Herr et al. ..... 52/212
4,012,868 A 3/1977 Andruszkiewicz
4,014,146 A 3/1977 DiMascio et al.
4,148,454 A * 4/1979 Carlson et al. ..... 248/222.11
4,718,195 A * 1/1988 Ortega ..... 49/380
4,856,241 A * 8/1989 Eriksson ..... 52/217
5,479,754 A * 1/1996 Pelvilain et al. ..... 52/745.16
6,178,717 B1 1/2001 Loop
6,192,638 B1 2/2001 Wang
6,282,851 B1 9/2001 Beaton
6,286,274 B1 9/2001 McKann et al.
6,293,061 B1 9/2001 Horak, Jr.
6,405,501 B1 6/2002 Cerrato
7,293,754 B2 * 11/2007 Gallien ..... 248/475.1

(Continued)

OTHER PUBLICATIONS

"The Way A Door Is Meant To Be Hung".

*Primary Examiner*—Robert J Canfield
(74) *Attorney, Agent, or Firm*—Price, Heneveld, Cooper, DeWitt & Litton, LLP

(57) ABSTRACT

A building fenestration that reduces the amount of time, effort and expense associated with installing a jamb in a rough opening of a building panel structure includes a jamb positioned plumb in the opening, the jamb having outwardly facing planar surfaces, at least one bracket receiving slot on at least one of the outwardly facing planar surfaces of the jamb, and a bracket having first and second legs at right angles to each other, the first leg of the bracket received in the bracket receiving slot and the second leg of the bracket fastened to the building panel structure, wherein the bracket receiving slot is defined between one of the outwardly facing planar surfaces of the jamb and a substantially flat plate.

17 Claims, 2 Drawing Sheets

U.S. PATENT DOCUMENTS

| | | | |
|---|---|---|---|
| 2001/0023557 | A1 | 9/2001 | Graham |
| 2003/0005644 | A1 | 1/2003 | Reithmeyer et al. |
| 2005/0193652 | A1 | 9/2005 | Cornell |
| 2005/0193653 | A1 | 9/2005 | Cornell |
| 2006/0213135 | A1 | 9/2006 | Mathes et al. |
| 2006/0272234 | A1 | 12/2006 | Curtis |
| 2007/0166498 | A1 | 7/2007 | Penar |
| 2008/0222980 | A1 | 9/2008 | Root et al. |

* cited by examiner

JAMB INSTALLATION BRACKET

FIELD OF THE INVENTION

This invention relates to the field of fenestration including the mounting of doors, windows, skylights, and the like in building walls, ceilings and the like, and more particularly to a jamb mounting assembly that reduces the amount of labor, time and materials needed for installation of a jamb.

BACKGROUND OF THE INVENTION

Conventional methods for installing a door jamb, window jamb or the like in a building wall or roof have generally involved positioning the jamb in a rough opening and filling the gaps between framing members of the opening and the jamb with wood shims. Properly trimming and installing the shims between the jamb and the frame defining the opening requires a considerable amount of time, skill and effort to properly fit the jamb in the opening so that the jamb is plumb. After the shims have been properly positioned, nails are driven through the jamb and the shims into the supporting framing members defining the opening. Thereafter, protruding pieces of the shims, if any, are cut flush with the edge of the jamb.

It is of course desirable to eliminate the use of shims and to simplify jamb installation. To this end, numerous efforts have been directed toward simplified, shimless jamb mounting systems. While many of these systems have very substantially reduced the amount of time and effort needed to install a jamb in a building panel structure, such as a wall or roof, further improvements are desirable. In particular, it would be desirable to reduce the number of fasteners needed for jamb installation and to provide simpler, easier to manufacture and less expensive jamb mounting brackets, and to provide a jamb mounting assembly that may be at least partially pre-installed on the jamb prior to shipment from the factory.

SUMMARY OF THE INVENTION

In one aspect of the invention, a building fenestration is provided which includes a jamb positioned in an opening defined by a building panel structure, at least one bracket receiving slot on an outwardly facing planar surface of the jamb, and a bracket having first and second legs at a right angle to each other, the first leg of the bracket received in the bracket receiving slot and the second leg of the bracket fastened to the building panel structure, wherein the bracket receiving slot is defined between one of the outwardly facing planar surfaces of the jamb and a substantially flat plate defined on or attached to the jamb. In accordance with this aspect of the invention, the jamb may be mounted in a building panel opening by positioning the jamb in the opening with one or more bracket receiving slots pre-defined or installed on outwardly facing planar surfaces of the jamb, the jamb being positioned so that it is plumb with the opening, inserting the first leg of the bracket into the bracket receiving slot and fastening the second leg of the bracket to the building panel structure.

In accordance with another aspect of the invention, there is provided a jamb mounting assembly comprising a jamb having planar outwardly facing peripheral surfaces; a bracket receiving slot on at least one of the planar outwardly facing peripheral surfaces of the jamb; and a bracket having first and second legs at a right angle to each other, the first leg of the bracket configured to be received in the bracket receiving slot and the second leg of the bracket configured for attachment to a building panel structure, wherein the bracket receiving slot is defined between one of the outwardly facing planar surfaces of the jamb and a substantially flat plate. In accordance with this aspect of the invention, installation is further simplified by providing a jamb having premounted or pre-defined bracket receiving slots, whereby installation of the jamb may be achieved by steps generally involving positioning of the jamb in an opening defined in a building panel structure, the jamb being positioned plumb with the opening, inserting the first leg of a panel bracket into each of the bracket receiving slots and fastening the second leg of each bracket to the building panel structure.

In accordance with another aspect of the invention, there is provided a jamb mounting assembly comprising a substantially flat plate adapted to be fastened to a planar outwardly facing peripheral surface of a jamb to define a bracket receiving slot, and a bracket having first and second legs at a right angle to each other, the first leg of the bracket configured to be received in the bracket receiving slot, and the second leg of the bracket configured for attachment to a building panel structure. The jamb mounting assembly in accordance with this aspect of the invention may be used on generally any jamb having planar outwardly facing peripheral surfaces.

In another aspect of the invention, there is provided a bracket for mounting a jamb to a wall with or without a bracket receiving slot. The bracket includes first and second legs at a right angle to each other and tangs projecting at a right angle from one of the legs to facilitate fastening of the bracket to the jamb.

In a further aspect of the invention, there is provided another bracket for mounting a jamb to a wall with or without a bracket receiving slot. This bracket includes first and second legs at a right angle to each other and tabs projecting at a right angle from one of the legs to facilitate fastening of the bracket to the jamb.

These and other features, advantages and objects of the present invention will be further understood and appreciated by those skilled in the art by reference to the following specification, claims and appended drawings.

DETAILED DESCRIPTION OF PREFERRED EMBODIMENTS

Figure 1:
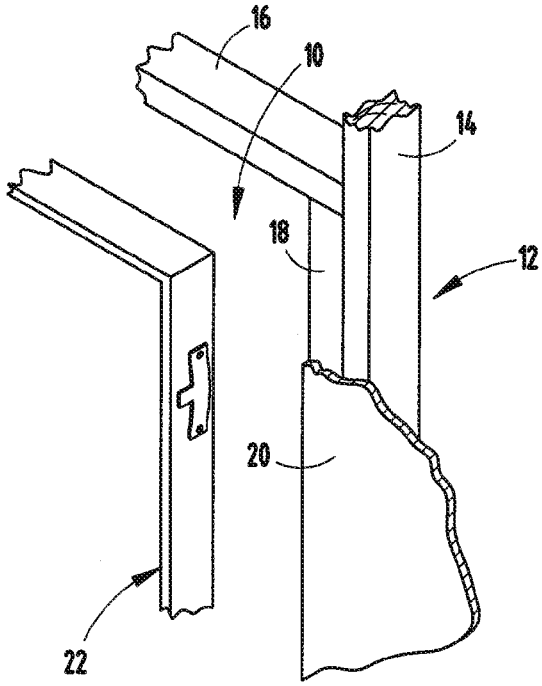
FIG. 1 is a fragmentary perspective view of a rough opening in a building wall that is about to receive a door jamb.

Shown in FIG. 1 is a rough opening 10 in a wall structure 12 formed by studs 14, and header 16 supported by liner members 18. Wall structure 12 may be covered with drywall panels 20 or the like to provide a finished wall, either before or after installation of jamb 22 in accordance with the invention.

The jamb mounting assemblies of this invention may be used for generally any type of building fenestration, including doors, windows, skylights and the like. In general, such fenestrations may be provided in accordance with this invention in various building panel structures, including exterior and interior wall structures, and roof structures.

Figure 2:
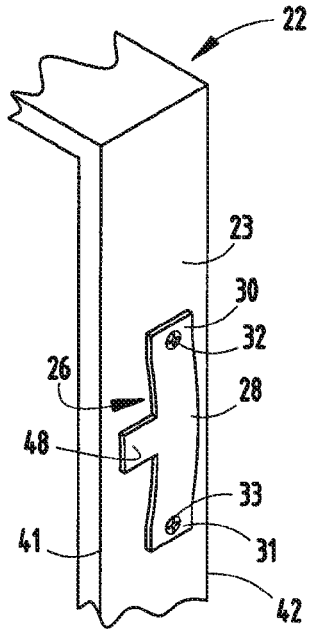
FIG. 2 is an enlarged fragmentary perspective view of the door jamb shown in FIG. 1 to illustrate certain details.
Figure 3:
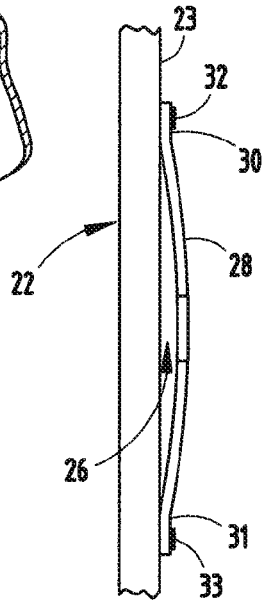
FIG. 3 is a fragmentary, side view of the door jamb shown in FIG. 2.
Figure 6:
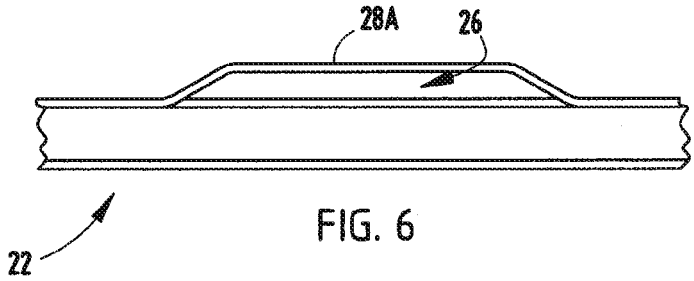
FIG. 6 is a fragmentary side view of an alternative embodiment of a jamb having an integrally formed bracket receiving slot.

As shown in greater detail in FIG. 2, outwardly facing peripheral surfaces 23 of jamb 22 are provided with panel bracket receiving slots 26. As shown in FIGS. 2 and 3, panel bracket receiving slot 26 may be defined between one of the outwardly facing planar surfaces 23 of jamb 22 and a substantially flat plate 28. The expression "substantially flat" as used to describe plate 28 is meant to encompass the fact that plate 28 is formed or bent slightly to allow flush mounting of opposite ends 30 and 31 of plate 28 to surface 23 of jamb 22 while allowing a sufficient gap between the ends of plate 28 to define a slot 26 into which a leg of a bracket may be received. Alternatively, as shown in FIG. 6, plate 28A can be formed as an integral section of the material used to fabricate jamb 22. This may be achieved such as by cutting and stamping operations. Thus, bracket receiving slot 26 may be defined by pre-installed plates 28 fastened to surface 23 of jamb 22 with fasteners 32, 34 (screws, rivets or the like) by the jamb manufacturer; attached by the jamb installer; or integrally preformed on jamb 22.

After installation, pre-installation or integral forming of bracket receiving slots 26 on jamb 22, jamb 22 is positioned in plumb in opening 10. Thereafter, a bracket 34 is used to secure jamb 22 in plumb in rough opening 10. Bracket 34 includes a first leg 36 and a second leg 38 which is at a right angle to leg 36. A forward edge 40 of first leg 36 is inserted into bracket receiving slot 26 until second leg 38 is flush against finish panels 20 (e.g., drywall or the like) or flush against liner 18 or stud 14. Thereafter, each bracket 34 may be secured to the building panel structure (e.g., wall structure or ceiling structure) with a single fastener (such as a screw or nail). However, bracket 34 may be configured for attachment with multiple fasteners if desired. In the illustrated embodiment, a single fastener aperture 42 is provided through second leg 38 of bracket 34.

In those cases in which bracket 34 is attached directly to studs 14 or liner member 18, drywall or other finish wall material 20 may be subsequently installed over bracket 34. In the case where bracket 34 is installed over drywall or other finish wall material 20, exposed surfaces of leg 38 of bracket 34 may be primed, covered with spackle or the like to facilitate application of paint, wallpaper or the like. Thus, the invention facilitates installation of a door or window jamb in a wall or installation of a skylight in a roof generally any time after framing of the walls or roof have been completed. After jamb 22 and finish wall material 20 have been installed, various trim options may be employed to cover the gap between jamb 22 and the wall and to conceal brackets 34. If desired, insulation (such as foam or glass fiber) may be inserted into the gap between jamb 22 and the wall prior to adding the finish trim.

As can be seen by reference to FIG. 2, flat plate 28 can be located entirely between corners 41 and 42 of the outwardly facing planar surface 23 of jamb 22. This arrangement allows exceptional flexibility with respect to the use of exposed trim for concealing the gap between rough opening 10 and surfaces 23 of jamb 22. Further, because plate 28 is substantially flat and/or is located entirely between the edges of the outwardly facing planar surfaces 23 of jamb 22, pre-installed plates 28 have a very low profile that should not interfere with or require modification to packaging materials or shipping procedures for pre-hung doors, pre-hung windows and the like.

In the illustrated embodiment, the details of which are shown in FIG. 2, flat plate 28 includes a tab 48 which projects from a lateral edge of flat plate 28 and which extends through an aperture 50 defined in leg 38 of bracket 34 (FIG. 4) when leg 36 of bracket 34 is inserted into slot 26. As shown in FIG. 5, tab 48 may optionally be bent at a right angle flush with the exposed surface of leg 38 or bracket 34.

Figure 4:
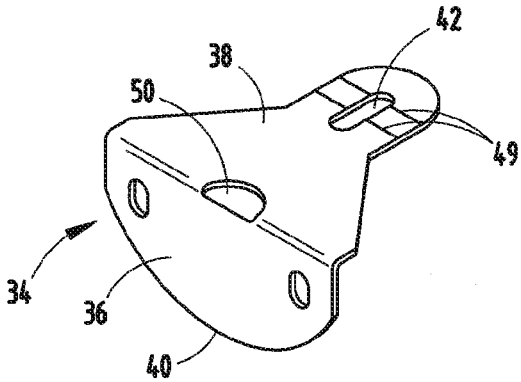
FIG. 4 is a perspective view of a bracket for securing a jamb in a rough opening.
Figure 5:
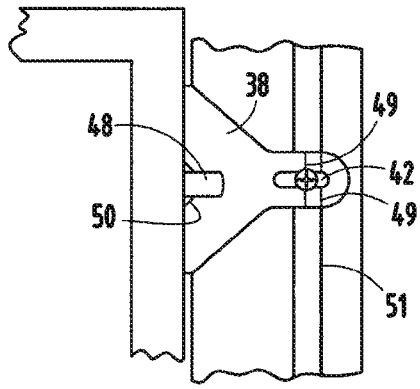
FIG. 5 is a fragmentary, front elevational view of a jamb installed in a rough opening employing the bracket shown in FIG. 4.

As shown in FIG. 4, leg 38 of bracket 34 may be provided with one or more scribe lines 49 that may be aligned with a plumb line 51 (FIG. 5) drawn on the wall, liner 18, stud 14 or the like.

Leading edge 40 of leg 36 of bracket 34 may have a tapered shape that becomes progressively narrower away from second leg 38, and may be curved to facilitate easier insertion of leg 36 of bracket 34 into slot 26.

Figure 7:
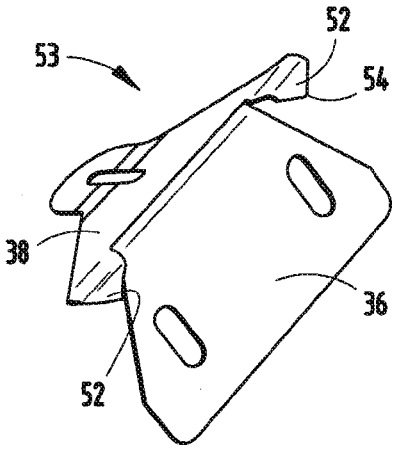
FIG. 7 is a perspective view of an alternative bracket for securing a jamb in a rough opening.
Figure 8:
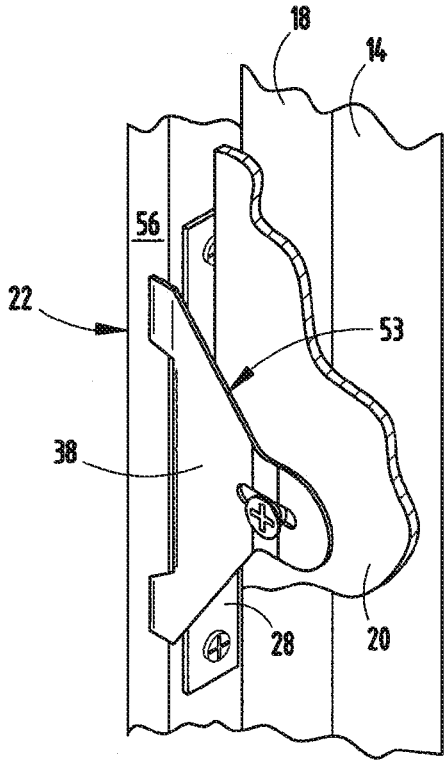
FIG. 8 is a fragmentary perspective view of the bracket shown in FIG. 7 being used to secure a jamb in a rough opening.

FIG. 7 shows an alternative bracket 53 having a first leg 36 and a second leg 38, in which tangs 52 are provided. Tangs 52 project at a right angle from second leg 38 along a plane parallel to first leg 36 in the direction of leg 36, and have sharp or pointed ends 54 that allow bracket 53 to penetrate an edge 56 of jamb 22 as shown in FIG. 8 to firmly secure bracket 53 to jamb 22. Bracket 53 is otherwise generally similar to and used in a similar way to bracket 34. However, bracket 53 may be used either with or without plate 28 or 28A.

Figure 9:
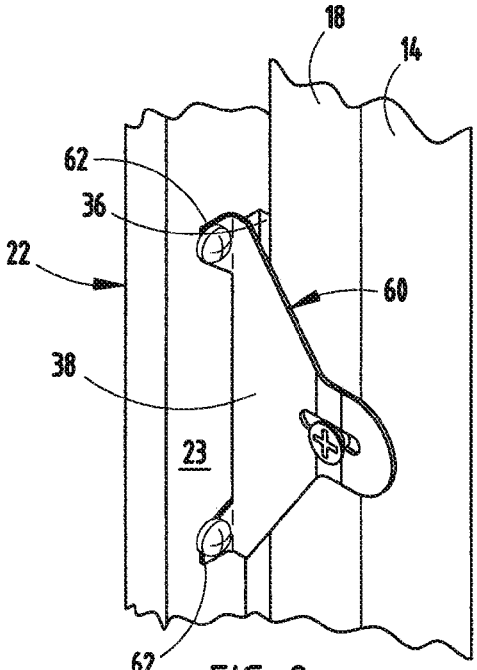
FIG. 9 is a fragmentary perspective view of another alternative bracket being used to secure a jamb in a rough opening.

FIG. 9 shows another alternative bracket 60 having a first leg 36 and a second leg 38, in which fastener tabs 62 are provided. Tabs 62 projects at a right angle from second leg 38 along a plane parallel to first leg 36 in a direction opposite leg 36. Tabs 62 may be provided for firmly securing bracket 60 to outwardly facing planar surface 23 of jamb 22. Bracket 60 is otherwise generally similar to and used in a similar way to bracket 34. However, bracket 60 may be used either with or without plate 28 or 28A, and is normally used before wall covering 20 is installed.

The various aspects of this invention provide a simple, fast, effective way to secure jambs to building panel structures such as wall structures and roof structures. In accordance with certain aspects of the invention, installation is further simplified by integrally forming or factory installing structure to define a bracket receiving slot, whereby after the jamb has been properly positioned in a rough opening, installation is completed by simply sliding a bracket into each of the bracket receiving slots provided and fastening each bracket to the building panel structure. The invention may be used with either new construction or during remodeling or renovation, and with or without finish material (e.g., drywall) applied to the building panel structure. Because the structure defining the bracket receiving slot is separate from the brackets until installation is nearly complete, bracket 34 is self-adjusting to various wall thicknesses with or without finish material applied to the building panel structure. For a typical installation, only one screw per bracket is needed. Thus, for a typical pre-hung door jamb installation, after proper positioning of the door and door jamb in a rough opening, installation is completed by merely inserting a bracket into each of the seven bracket receiving slots, and securing each of the brackets to the wall structure, such as with a single fastener (e.g., a screw).

Another advantage with the substantially flat configuration of plate 28 or 28A is that it is very inexpensive, and therefore can be pre-installed or pre-formed on every jamb shipped from a manufacturer without interfering with an installer's ability to either employ brackets 34 as disclosed herein or to employ conventional installation methods if desired. In accordance with this aspect of the invention, incorporating pre-formed or pre-installed plates 28 or 28A, manufacturers are provided with control over where and how often attachment of a jamb takes place, allowing positioning and placement of the jamb bracket to be controlled by the manufacturer. Because of the very simple, low profile and compact design of the structure (28 or 28A) defining the bracket receiving slots 26, structure 28 or 28A does not interfere with or require any modification of typical shipping and delivery methods that are currently employed. The invention allows full insulation of the cavity defined between a jamb and a building panel structure because attachment of the jamb may be achieved by securement of brackets 34 to the interior side of an exterior wall. This allows the cavity to be filled, usually from the inside, with fiberglass or foam insulation to increase energy efficiency of the installation as whole, making the total unit more energy efficient in the completed fenestration. Because the installation is very simple and self-adjusting, poor workmanship issues are eliminated or very substantially reduced, decreasing warranty issues.

The above description is considered that of the preferred embodiment(s) only. Modifications of the invention will occur to those skilled in the art and to those who make or use the invention. Therefore, it is understood that the embodiment(s) shown in the drawings and described above are merely for illustrative purposes and not intended to limit the scope of the invention, which is defined by the following claims as interpreted according to the principles of patent law, including the doctrine of equivalents.

The invention claimed is:

1. A building fenestration comprising:

a building panel structure having an opening bounded by surfaces facing toward the opening;

a jamb positioned in the opening, the jamb having outwardly facing surfaces, the jamb configured to define a gap between the outwardly facing surfaces of the jamb and the surfaces of the building panel structure defining the opening;

at least one bracket receiving slot on at least one of the outwardly facing planar surfaces of the jamb; and a bracket having first and second legs at a right angle to each other, the first leg of the bracket received in the bracket receiving slot, and the second leg of the bracket fastened to the building panel structure;

wherein the bracket receiving slot is defined between one of the outwardly facing surfaces of the jamb and a substantially flat plate located entirely between corners of the outwardly facing surface of the jamb, the substantially flat plate being without features that project outwardly from the substantially flat plate, whereby the substantially flat plate may be integrally formed on the jamb or preinstalled on the jamb to provide a very low profile that will not interfere with packaging material or shipping procedures for pre-hung doors or pre-hung windows on which the substantially flat plate is provided.

2. The building fenestration of claim 1, wherein the substantially flat plate is attached to one of the outwardly facing surfaces of the jamb.

3. The building fenestration of claim 1, wherein the substantially flat plate is integrally formed of the jamb material.

4. The building fenestration of claim 1, wherein the bracket includes an aperture, and a tab projects from an edge of the flat plate into the aperture of the bracket.

5. The building fenestration of claim 4, wherein the tab is bent at a right angle against the second leg of the bracket.

6. The building fenestration of claim 1, wherein the first leg of the bracket has a tapered shape that becomes progressively narrower away from the second leg of the bracket.

7. The building fenestration of claim 6, wherein an edge of the first leg of the bracket opposite the second leg of the bracket is curved.

8. The building fenestration of claim 1, wherein the bracket has tangs that project at a right angle from the second leg along a plane parallel to the first leg to facilitate fastening of the bracket to the jamb.

9. The building fenestration of claim 1, wherein the bracket has tabs that project at a right angle from the second leg along a plane parallel to the first leg to facilitate fastening of the bracket to the jamb.

10. The building fenestration of claim 1, wherein the bracket includes at least one scribe line on the second leg to facilitate alignment of the bracket with a plumb line.

11. A jamb and jamb mounting assembly comprising:

a jamb having outwardly facing peripheral surfaces;

a bracket receiving slot on at least one of the peripheral surfaces of the jamb; and a bracket having first and second legs at a right angle to each other, the first leg of the bracket configured to be received in the bracket receiving slot, and the second leg of the bracket configured for attachment to a building panel structure;

wherein the bracket receiving slot is defined between one of the outwardly facing surfaces of the jamb and a substantially flat plate located entirely between corners of the outwardly facing peripheral surfaces of the jamb, the substantially flat plate being without features that outwardly from the substantially flat plate at a location that is not between the corners of the outwardly facing peripheral surfaces of the jamb, whereby the substantially flat plate may be integrally formed on the jamb or preinstalled on the jamb to provide a very low profile that will not interfere with packaging materials or shipping procedures for pre-hung doors or pre-hung windows on which the substantially flat plate is provided.

12. The jamb and jamb assembly of claim 11, wherein the substantially flat plate is attached to one of the outwardly facing surfaces of the jamb.

13. The jamb and jamb assembly of claim 11, wherein the substantially flat plate is integrally formed of the jamb material.

14. The jamb and jamb assembly of claim 11, wherein the bracket includes an aperture, and a tab projects from an edge of the flat plate into the aperture of the bracket.

15. The jamb and jamb assembly of claim 14, wherein the tab is bent at a right angle against the second leg of the bracket.

16. The jamb and jamb assembly of claim 11, wherein the first leg of the bracket has a tapered shape that becomes progressively narrower away from the second leg of the bracket.

17. The jamb and jamb assembly of claim 16, wherein an edge of the first leg of the bracket opposite the second leg of the bracket is curved.

* * * * *

UNITED STATES PATENT AND TRADEMARK OFFICE

CERTIFICATE OF CORRECTION

PATENT NO. : 7,716,886 B2
APPLICATION NO. : 11/860463
DATED : May 18, 2010
INVENTOR(S) : Randy S. Gordon It is certified that error appears in the above-identified patent and that said Letters Patent is hereby corrected as shown below:

*Col. 4, line 34, "projects" should be --project--.

*Col. 5, line 18, "as whole" should be --as a whole--.

Col. 6, claim 11, lines 36-37, "features that outwardly from" should be --features that project outwardly from--.

Signed and Sealed this

Sixteenth Day of November, 2010

David J. Kappos

David J. Kappos
*Director of the United States Patent and Trademark Office*